US005185598A

United States Patent [19]

Sakamoto

[11] Patent Number: 5,185,598

[45] Date of Patent: Feb. 9, 1993

[54] CHARACTER GRAPHIC INFORMATION DISPLAY DEVICE

[75] Inventor: Ken Sakamoto, Takatsuki, Japan

[73] Assignee: Matsushita Electric Industrial Co., Ltd., Osaka, Japan

[21] Appl. No.: 640,622

[22] Filed: Dec. 21, 1990

[30] Foreign Application Priority Data

Dec. 21, 1989 [JP] Japan ..... 1-334432

[51] Int. Cl.[5] ..... G09G 1/06

[52] U.S. Cl. ..... 340/721; 340/723; 340/731; 340/744

[58] Field of Search ..... 340/721, 728, 723, 731, 340/744, 748, 814

[56] References Cited

U.S. PATENT DOCUMENTS 4,366,475 12/1982 Kishi et al. ..... 340/731
4,410,958 10/1983 Demke et al. ..... 340/721
4,435,703 3/1984 Hunt et al. ..... 340/723
4,757,311 7/1988 Nakamura et al. ..... 340/731
5,016,000 5/1991 Bugg ..... 340/731

*Primary Examiner*—Jeffery A. Brier
*Assistant Examiner*—Jick Chin
*Attorney, Agent, or Firm*—Wenderoth, Lind & Ponack

[57] ABSTRACT

A character graphic information display device is adapted to decode into the character graphic picture images with the standard density the high density of character graphic information which has been transmitted so as to display it on the display portion after passing through the memory and the processing circuit; the desired region may be displayed on the whole display portion as the high density picture images by the operation of the keypad. Also order to obtain other regions as the high density picture images, the other high density picture images are continuously displayed only by the movement of the cursor in the condition of the high density picture face.

5 Claims, 6 Drawing Sheets picture face 1
picture face 2
picture face 3
picture face 4
second region display region

CHARACTER GRAPHIC INFORMATION DISPLAY DEVICE

BACKGROUND OF THE INVENTION

The present invention generally relates to a character graphic information display device which decodes and processes the received character graphic information so as to display it on a display portion.

In recent years, a videotex which is capable of projecting character graphic information such as news, weather forecasts, stock market information and so on composed of characters and figures, onto the picture face of a television image receiving machine for home use using a telephone circuit, and a character multiplex broadcasting arrangement which similarly transmits the character graphic information with broadcasting waves have been put into practical use. Furthermore, recently the character graphic information (rank 3 or rank 5 picture faces) having a higher display density have been provided for services. Although a personal display device having a higher display performance of its display portion including a display device such as CRT or the like is needed in order to display the character graphic information of higher density, it becomes much higher in price. The present inventors thin out the picture elements of the high density picture face so as to convert it into a standard density display, or display only one portion of the high density picture face so as to receive the character graphic information of a higher density with the conventional television image receiving machine, and develop a character graphic information display device.

Such a character graphic information display apparatus as described hereinabove will be described hereinafter with reference to the drawings.

FIG. 1 shows the construction of the conventional character graphic information display device. Referring to FIG. 1, reference numeral 1 is a character graphic information decoding portion for decoding the character graphic information into character graphic picture images; reference numeral 2 is a microprocessor circuit for controlling the character graphic information decoding portion; reference numeral 3 is a receiving circuit for fetching the character graphic information as digital data from the picture image signals; reference numeral 4 is a RAM for storing the received character graphic information, using it as a working region of the microprocessor circuit 2; reference numeral 5 is a ROM for accommodating a program for controlling the microprocessor circuit 2; reference numeral 7 is a display memory for storing the character graphic picture images decoded by the microprocessor circuit 2; reference numeral 6 is a display processing circuit for composing into RGB signals the character graphic picture images stored in the display memory 7; reference numeral 9 is a character generator for using the character graphic information by decoding it into the character graphic picture images, reference numeral 8 is an additional sound decoder for processing the additional sound data to be included in the character graphic information; reference numeral 10 is a keypad for instructing the selection of the character graphic information to the character graphic information decoding portion. Reference numeral 20 is a television signal receiving portion; reference numeral 21 is an antenna; reference numeral 22 is a television signal receiving circuit; reference numeral 23 is an audio demodulation amplifying circuit; reference numeral 24 is a brilliance amplification color demodulating circuit; reference numeral 25 is a picture image audio switching circuit for switching or mixing among the picture image audio signal of the television, the RGB signal to be outputted from the character graphic information decoding portion, and the additional sound signal; reference numeral 26 is an audio amplification outputting circuit; reference numeral 28 is a speaker; reference numeral 27 is a picture image amplification outputting circuit; reference numeral 29 is a display portion for displaying the picture images, where, for example, a cathode-ray tube is used.

The operation of the character graphic information display device of such character as described hereinabove will be described hereinafter.

The television signal received from the antenna 21 is demodulated by a television signal receiving circuit 22 of the television signal receiving portion 20, with the picture image signal and the audio signal being fetched from the output thereof. The picture image signal is inputted into the receiving circuit 3 of the character graphic information decoding portion 1. The receiving circuit 3 fetches the character graphic information from among the picture image signals. A user instructs the microprocessor circuit 2 as to the selection of the desired character graphic information from among all of the character graphic information by the operation of the keypad 10. The microprocessor circuit 2 selects the instructed character graphic information, and stores it in the RAM 4, and also, processes the decoding operation, converts it into the character graphic picture images, stores it in the display memory 7 using the character generator 9 whenever necessary in accordance with the contents of the program stored in the ROM 5. The character graphic picture images stored in the display memory 7 are composed into RGB signals by the display processing circuit 6. Also, the additional sound data to be included in the character graphic signal is converted into the additional sound signal by the additional sound decoder 8.

The audio signal and the picture image signal demodulated by the television receiving circuit 22 are inputted and processed respectively into the audio demodulation amplifying circuit 23, the brilliance amplification . color demodulating circuit 24, and are inputted into a picture image audio switching circuit 25. The picture image audio switching circuit 25 selects the former in the displaying of the character graphic picture image, selects the latter in the displaying of the television picture images by the switching of the picture image signal (RGB signal) and an audio signal (additional sound signal) to be outputted from the character graphic information decoding portion 1, and the picture image signal of the television and the audio signal. The selected audio signal and the picture image signal are respectively inputted into the speaker 28, the display portion 29 respectively through the audio amplification outputting circuit 26 and the picture image amplification outputting circuit 27. By the above described operation, the user may display on the display portion 29 the selected character graphic information.

With respect to such a character graphic information display device, the present inventors have thought of thinning out the picture elements of the high density picture face by the microprocessor circuit 2, when the display density of the received character graphic information is higher, to convert it into the standard density for storing it in the display memory 7. When the picture face with the density being converted into the standard density cannot be made out, the picture face region to be displayed is keyed in to the microprocessor circuit 2 by the operation of the keypad 10. By the storing of the instructed region in the display memory 7, the microprocessor circuit 2 can display only one portion of the high density picture face on the display portion 29.

In a character graphic information display device of such a construction as described hereinabove, the operations of, first, contracting the whole picture face information to display it, then, specifying a display region for expanding, displaying it, and expanding, displaying it are necessary. Furthermore when a different region is desired to be expanded, displayed, it is necessary to once display the whole picture face information, and to specify again the region desired to be expanded, so that the simplicity of the use is desired. Also, if the specification of the expanded region is the same as the high density picture face when the character graphic information is composed of a plurality of standard density picture faces, one standard density picture face has to be specified by a plurality of operations. Although there is a character graphic information with the high density picture face and the standard density picture face being mixed in it, only the high density picture face is expanded in consideration of the easy-to-see high density picture face, thus causing the different feelings with respect to the standard density picture face, with a defect that the picture face is not correctly displayed. When the displaying operation is effected by the expansion of one region portion of the picture face, the character graphic information except for in the display region to be expanded, displayed takes more processing time, because the processing which is the same as the processing for the displaying operation is effected, with a problem that the picture face information in the region desired to be displayed is not displayed immediately.

SUMMARY OF THE INVENTION

Accordingly, the present invention has been developed with a view to substantially eliminating the above discussed drawbacks inherent in the prior art, and has for its essential object to provide an improved character graphic information display device.

Another important object of the present invention is to provide an improved character graphic information display device which is adapted to capable of displaying, with simpler operations, and with efficiency, the character graphic information higher in display density, with the functions of the normal television image receiving machine.

In accomplishing these and other objects, according to one preferred embodiment of the present invention, there is provided a character graphic information display apparatus which includes a receiving circuit for receiving the character graphic information including the display control information, a display memory for storing the character graphic picture images to be obtained by the decoding, processing of the character graphic information, a first decoding means for decoding the character graphic information into the character graphic picture images with the display density different from the display density specified by the above described display control information, a second decoding means for decoding one portion of the above described character graphic information into the character graphic picture images with the display density specified by the above described display control information, and a display processing circuit for displaying on the display portion the character graphic picture images stored on the above described display memory. The character graphic information display device is composed of a first region display means which is capable of continuously specifying, displaying the region to be displayed by the above second decoding means, a second region display means which is capable of specifying, displaying into the picture face unit the region to be displayed by the second decoding means when the character graphic information is composed of one picture face with a plurality of picture faces, a display control means for controlling so as to effect the displaying operation by both the means of the first decoding means and the second decoding means with the picture face specified to be displayed with the highest density being provided as a standard when the character graphic information is composed of one picture face with a plurality of display density. Further, the character graphic information display device is composed of a region selection means for displaying only the specified region at a high speed by the omission of the processing of the character graphic information except for the region to be displayed by the second decoding means.

By the construction, the character graphic information (level B in the television character multiplex broadcasting, rank 3 and rank 5 in the captain) which is higher in the display density received by the receiving circuit is displayed in the whole character graphic picture image with the reduced standard density by the first decoding means, and may be displayed in the whole display portion with the density, such as high density, specified partially in the character graphic picture image by the second decoding means. Also, one portion of the character graphic picture image to be displayed with high density by the first region display means may be continuously moved. Also, when the character graphic picture image is composed of one picture face with a plurality of contracted picture faces, it is possible to move the positional setting of the display thereof to the picture face unit by the second region display means. Also, when the character graphic information composes one picture face with a plurality of display densities, it is possible to correctly display with the picture face where the displaying is specified with the highest density by the display control means being provided as the standard. Further, it becomes possible to effect processing . displaying operations at a high speed by the omission, by the region selecting means, of the processing except for the display-specified region.

BRIEF DESCRIPTION OF THE DRAWINGS

These and other objects and features of the present invention will become apparent from the following description taken in conjunction with the preferred embodiment thereof with reference to the accompanying drawings, in which.

PREFERRED EMBODIMENT OF THE INVENTION

Figure 1:
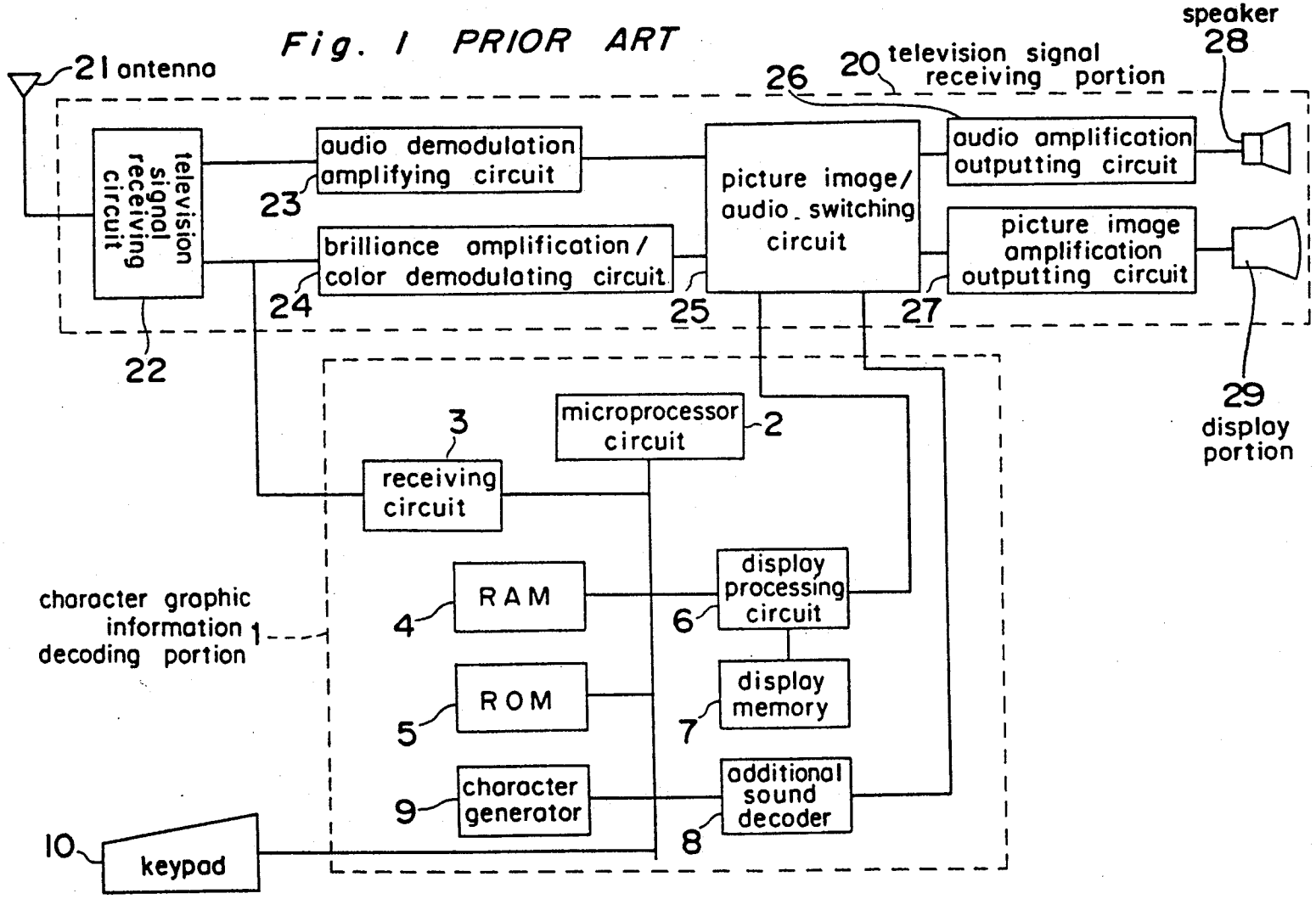
Fig. 1 PRIOR ART
FIG. 1 is a block diagram of a character graphic information display device in the conventional embodiment.

Before the description of the present invention proceeds, it is to be noted that like parts are designated by like reference numerals throughout the accompanying drawings.

Figure 2:
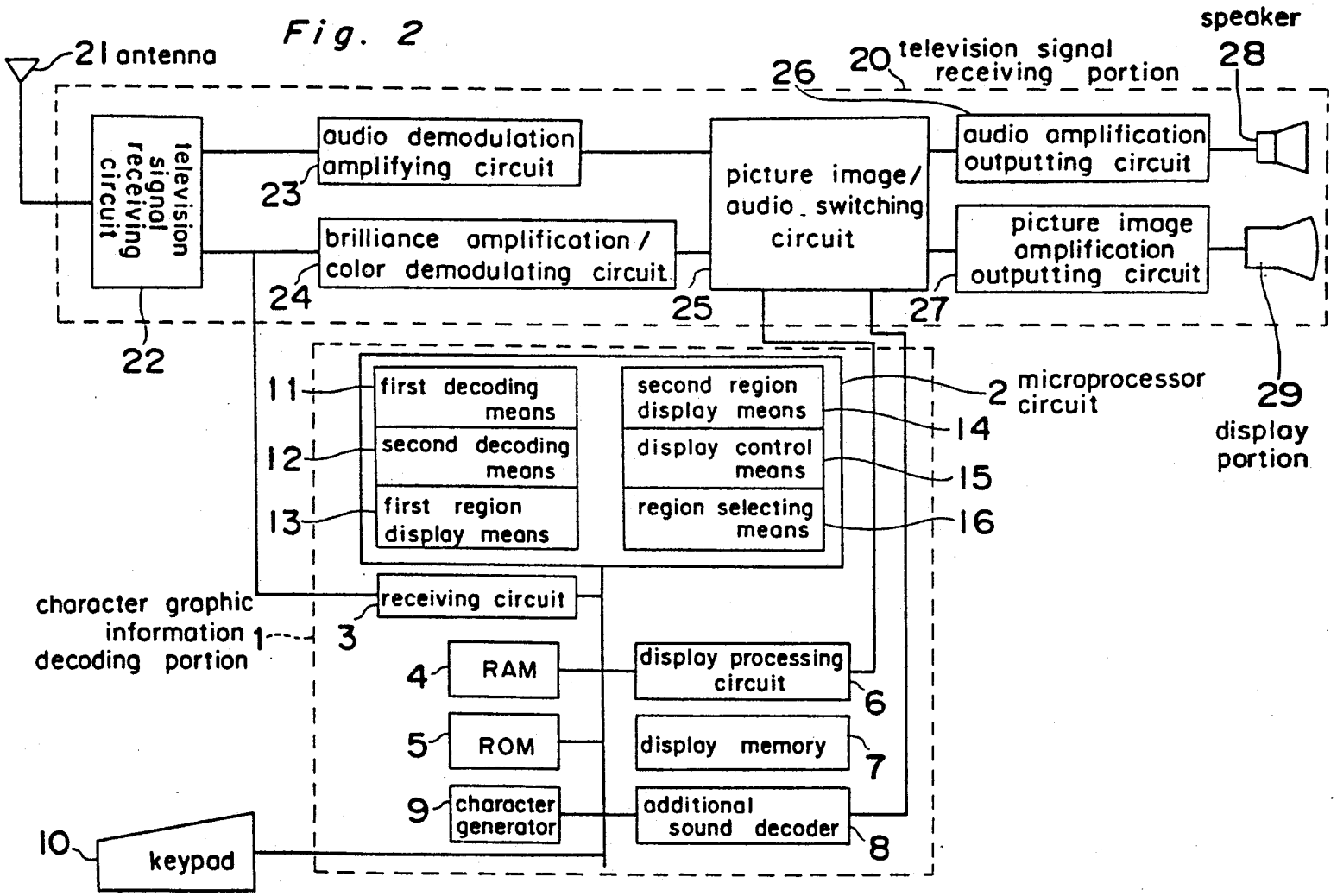
FIG. 2 is a block diagram of a character graphic information display device in one embodiment of the present invention.
Figure 3A:
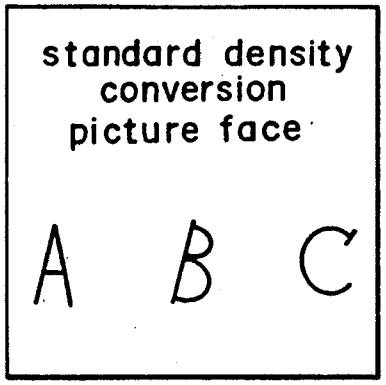
FIGS. 3(*a*) through (*f*) are the picture faces showing the display examples for illustrating the operation of the FIG. 2.
Figure 3B:
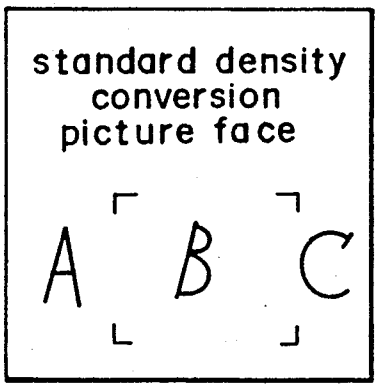
Figure 3C:
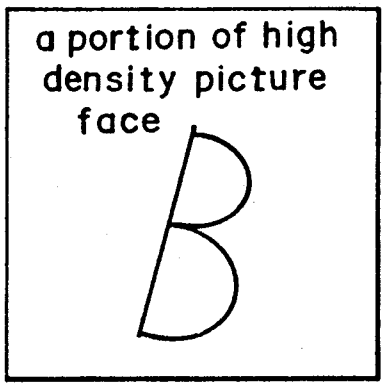
Figure 3D:
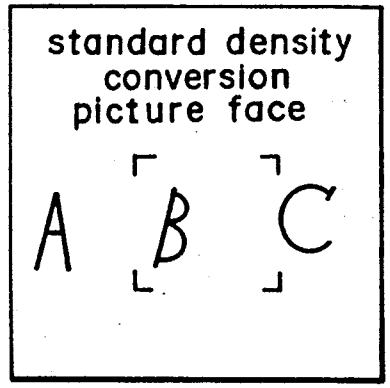
Figure 3E:
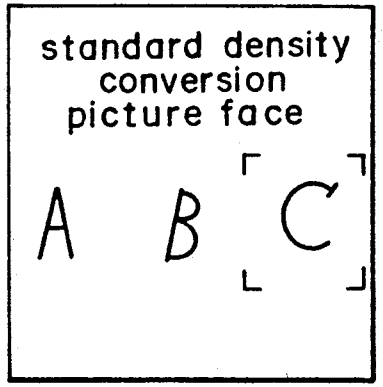
Figure 3F:
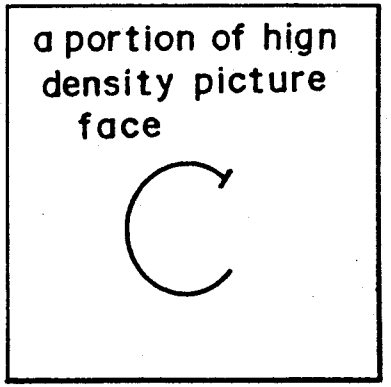

Referring now to the drawings, there is shown in FIG. 2, the construction of a character graphic information display device according to one embodiment of the present invention. The microprocessor circuit 2 has a first decoding means 11, a second decoding means 12, a first region display means 13, a second region display means 14, a display control means 15, and a region selecting means 16. The first decoding means 11 decodes the character graphic information into the character graphic picture images with the display density different from the display density specified by the display control information to be included in the character graphic information. The second decoding means 12 decodes into the character graphic picture images with the display density where one portion of the above described character graphic information has been specified by the display control information. The first region display means 13 is to continuously specify and display the region display by the above described second decoding means 12. The second region display means 14 is to specify and display into the picture face unit the region to be displayed by the second decoding means 12 when the character graphic information constitutes one picture face with a plurality of contracted picture faces. The display control means 15 controls the operation so as to display both the means of the first decoding means 11 and the second decoding means 12 with the picture face specified to be displayed with the highest density being provided with the standard one when the character graphic information is composed of one picture face with a plurality of display densities. Also, the region selecting means 16 is to display only the specified region at a high speed by the omission of the character graphic information except for the region to be displayed by the second decoding means 12, with the same things being described as in FIG. 1 except for the above description.

The character graphic information display device of such construction as described hereinabove will be described hereinafter in its operation. The character graphic information display device in the present embodiment can be operated in the same fashion as the device shown in FIG. 1.

FIGS. 3(*a*) through 3(*f*) show drawings for illustrating the operation of the first decoding means 11, the second decoding means 12, and the first region displaying means 13. When the received character graphic information is the high density picture face, the first decoding means detects it and converts the high density picture face into the standard density picture face. The characters "ABC" are displayed, for example, on the display portion 29 as in FIG. 3 (*a*). When only one portion thereof is desired to be displayed in the original high density, as the contents cannot be made out by the conversion into the standard density, or for other reasons, a cursor is displayed by the operation of a particular first key of the keypad 10 so as to specify with the cursor the region such as the region of the character "B" as in FIG. 3(*b*). At a time point where the display region has been decided, a specific second key of the keypad 10 is operated so as to cause the second decoding means 12 to function, so that one portion of the picture face, namely, the region of the character "B" is displayed on the whole display portion with high density as shown in FIG. 3(*c*). In the present construction, by the operation of the cursor key of the keypad 10 from this condition, the first region display means 13 is operated and is converted again into the conventional standard density picture face as shown in FIG. 3 (*d*) so as to remove the operation of specifying the other region into the high density. Therefore, the region where the displaying operation is effected with high density can be continuously specified, displayed. Namely, although a→b→c→d→e→(f)→(d)→e→f . . .

in the conventional construction, a→b→c→f→f . . .

is provided in the present construction. Although the region in the right direction has been selected by the cursor key here, the other region may be displayed continuously similarly by the operation of the cursor key.

Figures 4A, 4B, 4C, 4D, 4E:
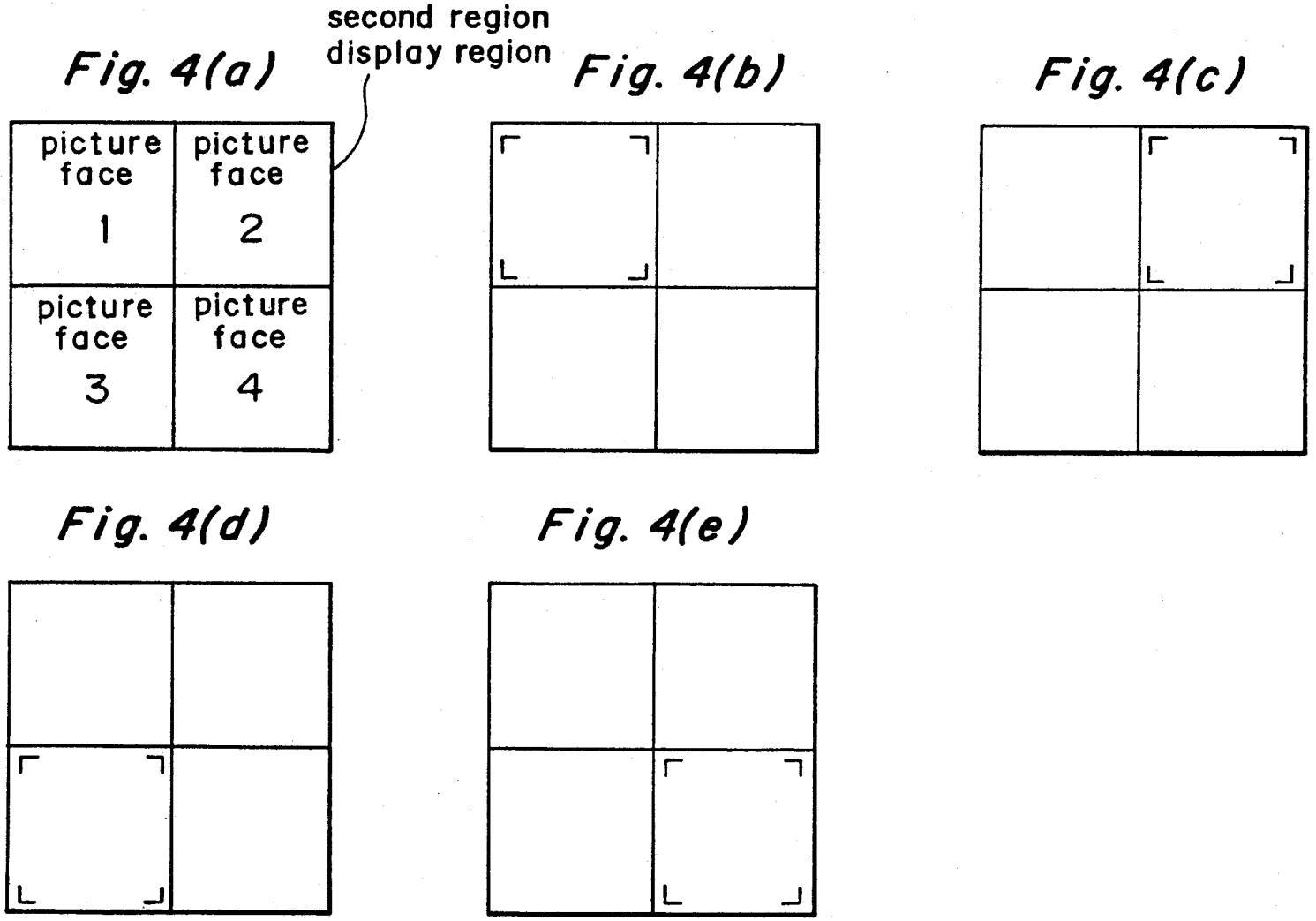
FIGS. 4(*a*) through 4(*e*), FIGS. 5(*a*) through 5(*c*), and FIG. 6 are respectively the picture faces for explaining the operations of the FIG. 2 embodiment.

FIGS. 4(*a*)–4(*e*) are drawings for illustrating the operation of the second region display region 14. The region of the target to be converted into the high density is to be specified by a plurality of operations of the keypad 10 when the region of one portion of the picture face converted into the standard density as described in FIGS. 3(*a*)–3(*f*) is normally specified. Here the operationality is inferior. There is a case the received character graphic information is respectively composed of a plurality of independent picture faces. FIGS. 4(*a*)–4(*e*) show one example thereof, where one character graphic information picture face is composed of four contracted standard density picture faces. At this time, the specification of the region is to be effected by the picture face unit as shown in FIG. 4(*b*), FIG. 4(*c*), FIG. 4(*d*), FIG. 4(*e*) by the action of the second region display means 14. In this manner, the specifying operation becomes very easy to effect. The specified either one of the picture faces is displayed as the high density picture face on the whole display portion as in FIGS. 3(*a*)–3(*f*).

Figure 5B:
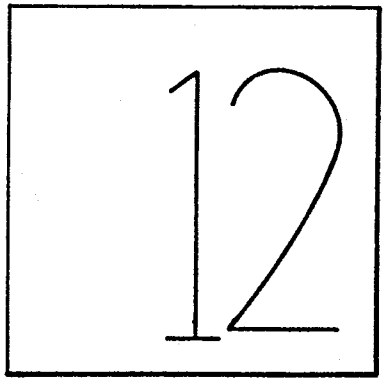
Figure 5C:
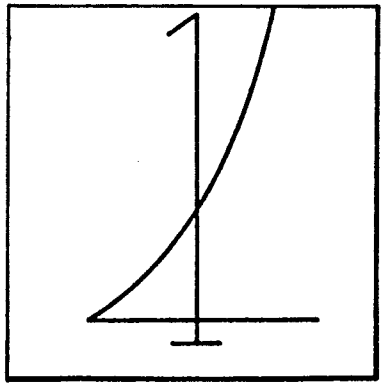
Figure 5A:
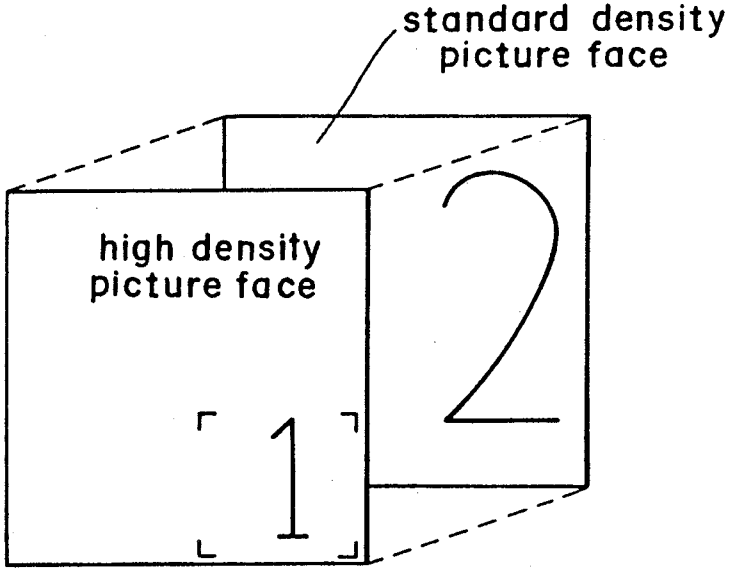

FIGS. 5(*a*)–5(*c*) are illustrating drawings in a case where the received character graphic information is composed of a plurality of densities. FIG. 5(*a*) shows an example where one picture face is composed of one high density picture face and one standard density picture face. When the second decoding means 12 is applied only to the high density picture face desired to be seen as shown in FIG. 5(*b*), the high density picture face is to be displayed on the whole display portion with the standard density picture face being provided as is. Therefore, the different feelings are caused among the respective picture faces so that the correct displaying operation becomes difficult to effect. By the application of the first decoding means 11 even to the standard density picture face by the display control means 15, the standard density picture face is also enlarged in condition as shown in FIG. 5(*c*), thus making it possible to correctly display both the picture faces. Here the first decoding means 11 functions to enlarge the standard density picture face.

Namely, the first decoding means is to operate to make the picture face density of the standard density picture face rougher (lower).

Figure 6:
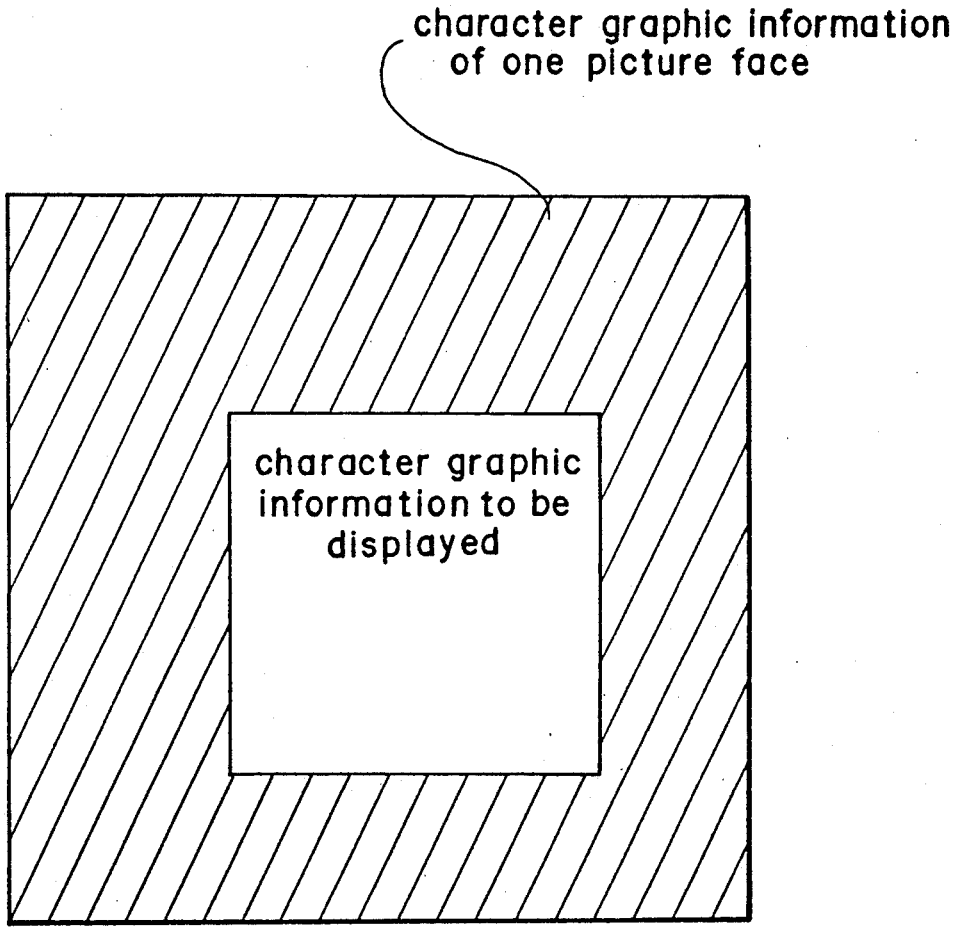

FIG. 6 is an operation illustrating drawing of the region selecting means 16. The whole square on the external side of FIG. 6 is a character graphic information of one picture face portion, with the square region on the internal side being the character graphic information to be displayed, which is equivalent to the region of the character "B" in FIGS. 3(*a*)–3(*f*). If the first decoding means 11 is applied to the character graphic information of one picture face portion when the character graphic information to be displayed is desired to be projected onto the whole display portion, it takes more time to display the character graphic information to be displayed of the square shape on the internal side of FIG. 6. In this case, it becomes possible to display the display region of the object at high speed by the omission of the processing of the character graphic information in the oblique lines of FIG. 6.

Although the character multiple broadcasting has been explained by way of example in the present embodiment, it is needless to say that the same things can be said for videotex.

As is clear from the foregoing description, according to the arrangement of the present invention, the character graphic picture images of high density may be displayed by the use of the display portion of the display performance of the standard density, and one portion of the display picture image may be displayed by the easier-to-use operation and the simpler operations, thus resulting in larger practical use.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A character graphic information display device comprising: a receiving circuit for receiving character graphic information including display control information; a display memory for storing character graphic picture images obtained by the decoding of the character graphic information; a first decoding means for decoding the character graphic information into character graphic picture images with a display density different from a display density specified by the display control information, said decoded character graphic information being stored in said display memory; a second decoding means for decoding a portion of the character graphic information into character graphic picture images with a display density specified by the display control information, said decoded portion of the character graphic information being stored in said display memory; and a display processing circuit for displaying on a display portion said character graphic picture images stored in said display memory.

2. A character graphic information display device as recited in claim 1, further comprising a first region display means for continuously specifying and displaying the region to be displayed in accordance with said second decoding means decoding.

3. A character graphic information display device as recited in claim 1, further comprising a second region display means for specifying and displaying the region to be displayed in accordance with said second decoding means decoding when the character graphic information is composed of one picture face with a plurality of contracted picture faces.

4. A character graphic information display device as recited in claim 1, further comprising a display control means for effecting a displaying operation in accordance with both said first decoding means and said second decoding means with the picture face specified to be displayed with the highest density being provided as a standard when the character graphic information is composed of one picture face with a plurality of display densities.

5. A character graphic information display device as recited in claim 1, further comprising a region selecting means for displaying only the specified region at a high speed by the omission of the processing of the character graphic information except for the region to be displayed in accordance with said second decoding means.

* * * * *